US009828160B2

(12) United States Patent
Ridgeway

(10) Patent No.: US 9,828,160 B2
(45) Date of Patent: Nov. 28, 2017

(54) SUSPENSION PACKAGING ASSEMBLY

(71) Applicant: SEALED AIR CORPORATION (US), Elmwood Park, NJ (US)

(72) Inventor: Devin Ridgeway, Chula Vista, CA (US)

(73) Assignee: Sealed Air Corporation (US), Charlotte, NC (US)

( * ) Notice: Subject to any disclaimer, the term of this patent is extended or adjusted under 35 U.S.C. 154(b) by 121 days.

(21) Appl. No.: 14/782,208

(22) PCT Filed: Mar. 27, 2014

(86) PCT No.: PCT/US2014/031963

§ 371 (c)(1),
(2) Date: Oct. 2, 2015

(87) PCT Pub. No.: WO2014/165381

PCT Pub. Date: Oct. 9, 2014

(65) Prior Publication Data

US 2016/0052691 A1 Feb. 25, 2016

Related U.S. Application Data

(60) Provisional application No. 61/807,482, filed on Apr. 2, 2013.

(51) Int. Cl.
*B65D 81/07* (2006.01)

(52) U.S. Cl.
CPC ..... *B65D 81/07* (2013.01); *B65D 81/075* (2013.01)

(58) Field of Classification Search
CPC .... B65D 81/07; B65D 81/075; B65D 5/5028; B65D 5/5038; B65D 81/05; B65D 5/12
USPC ..... 206/583, 594, 588, 521; 229/189
See application file for complete search history.

(56) References Cited

U.S. PATENT DOCUMENTS 5,388,701 A * 2/1995 Ridgeway ..... B65D 81/075 206/583
6,006,917 A * 12/1999 Loeffler ..... A61F 2/0095 206/363
6,302,274 B1 * 10/2001 Ridgeway ..... B65D 5/5038 206/583

(Continued)

FOREIGN PATENT DOCUMENTS

CN 2649492 Y 10/2004
JP H11208726 A 8/1999

(Continued)

OTHER PUBLICATIONS

Supplementary European Search Report, dated Sep. 29, 2016.
First Office Action, State Intellectual Property Office, P.R. China, dated Dec. 21, 2017.

*Primary Examiner* — Chun Cheung
(74) *Attorney, Agent, or Firm* — Jon M. Isaacson

(57) ABSTRACT

A frame useful in a suspension package includes a panel and a sheet attached to the panel. The panel has a central portion defining a panel opening. The sheet extends over the panel opening. First and second primary leg flaps extend from the central portion. The first and second primary leg flaps are foldable from an unfolded position to a folded position extending from the plane of the central portion. The panel also includes first and second auxiliary leg flaps foldably connected to the central portion.

20 Claims, 13 Drawing Sheets

(56) References Cited

U.S. PATENT DOCUMENTS

| | | | | |
|---|---|---|---|---|
| 2004/0140243 | A1* | 7/2004 | Roesel | B65D 5/5028 206/583 |
| 2010/0140333 | A1* | 6/2010 | McDonald | B65D 5/22 229/117.01 |
| 2011/0240515 | A1* | 10/2011 | Ridgeway | B65D 5/5028 206/583 |
| 2012/0273386 | A1 | 11/2012 | Miyazaki et al. | |
| 2014/0183097 | A1* | 7/2014 | LeRoy | B65D 75/305 206/583 |

FOREIGN PATENT DOCUMENTS

| | | | |
|---|---|---|---|
| JP | H11208727 | A | 8/1999 |
| JP | 2005313926 | A | 11/2005 |
| JP | 2007204068 | A1 | 8/2007 |
| JP | 2011207512 | A | 10/2011 |

* cited by examiner

SUSPENSION PACKAGING ASSEMBLY

CROSS REFERENCE TO RELATED APPLICATIONS

This application claims the benefit of U.S. Provisional Patent Application No. 61/807,482, filed Apr. 2, 2013, which is incorporated by reference herein in its entirety.

Various embodiments of the present invention relate to a frame useful in a suspension package, for example, a packaging assembly used to protect a packaged product during shipment by suspending the product between two frames within a box.

BACKGROUND

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "suspension packaging." In typical suspension packaging, the packaged product is suspended between two sheets each attached to opposing frames sized to fit within a corresponding box. Another type of packaging system is known as retention packaging. In typical retention packaging, a product is retained between a sheet and a rigid backing frame to which the sheet is attached. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, each of which is incorporated herein in its entirety by reference.

While existing suspension structures provide a level of protection for the packaged object, there is room for improvement, for example, by enhancing the ability of the system to suspend relatively large objects that may require suspension frames having relatively tall leg assemblies, while minimizing the increased use of materials to provide the enhancement.

SUMMARY

One or more embodiments of the presently disclosed subject matter may address one or more of the aforementioned problems. A frame that is useful in a suspension package includes a panel and a sheet attached to the panel. The panel includes first and second opposing fold lines that delineate: (1) a central portion between the first and second fold lines, (2) a first primary leg flap extending from the first fold line, and (3) a second primary leg flap extending from the second fold line. The central portion defines a panel opening. The sheet is attached to the panel and extends over the panel opening.

The first primary leg flap is foldable along the first fold line from an unfolded position generally coplanar with the central portion to a folded position extending from the plane of the central portion. The first primary leg flap has a given length L1 from the first fold line to the outer edge of the first primary leg flap opposite the first fold line.

The second primary leg flap is foldable along the second fold line from an unfolded position generally coplanar with the central portion to a folded position extending from the plane of the central portion. The second primary leg flap has a given length L2 from the second fold line to the outer edge of the second primary leg flap opposite the second fold line.

The panel also includes a first auxiliary leg flap foldably connected to the central portion along a third fold line that is generally parallel to the first fold line. The first auxiliary leg flap has a fourth fold line generally parallel to the third fold line and delineating the first auxiliary leg flap into a first proximal portion between the third and fourth fold lines and a first distal portion extending from the fourth fold line. The first proximal portion has a given length L3 from the third fold line to the fourth fold line. L3 is greater than L1. The first auxiliary leg flap is foldable from a disengaged position extending into the panel opening to an engaged position in which the first proximal portion extends from the plane of the central portion and the first distal portion engages the first primary leg flap in the folded position to create a first leg assembly.

The panel also includes a second auxiliary leg flap foldably connected to the central portion by a fifth fold line generally parallel to the second fold line. The second auxiliary leg flap has a sixth fold line generally parallel to the fifth fold line and delineating the second auxiliary leg flap into a second proximal portion between the fifth and sixth fold lines and a second distal portion extending from the sixth fold line. The second proximal portion has a given length L4 from the fifth fold line to the sixth fold line. L4 is greater than L2, The second auxiliary leg flap is foldable from a disengaged position extending into the panel opening to an engaged position in which the second proximal portion extends from the plane of the central portion and the second distal portion engages the second primary leg flap in the folded position to create a second leg assembly.

Various embodiments of the present invention can provide for "shortened" leg flap lengths, which allows for reduced use of material, yet retains the leg flap functionality of enhanced structural rigidity and strength provided by a folded leg flap, while also providing for leg assemblies having enhanced height to support the central portion of the suspension frame and allows for suspension of "larger" products between opposing suspension frames.

These and other objects, advantages, and features of the presently disclosed subject matter will be more readily understood and appreciated by reference to the detailed description and the drawings.

Figure 1:
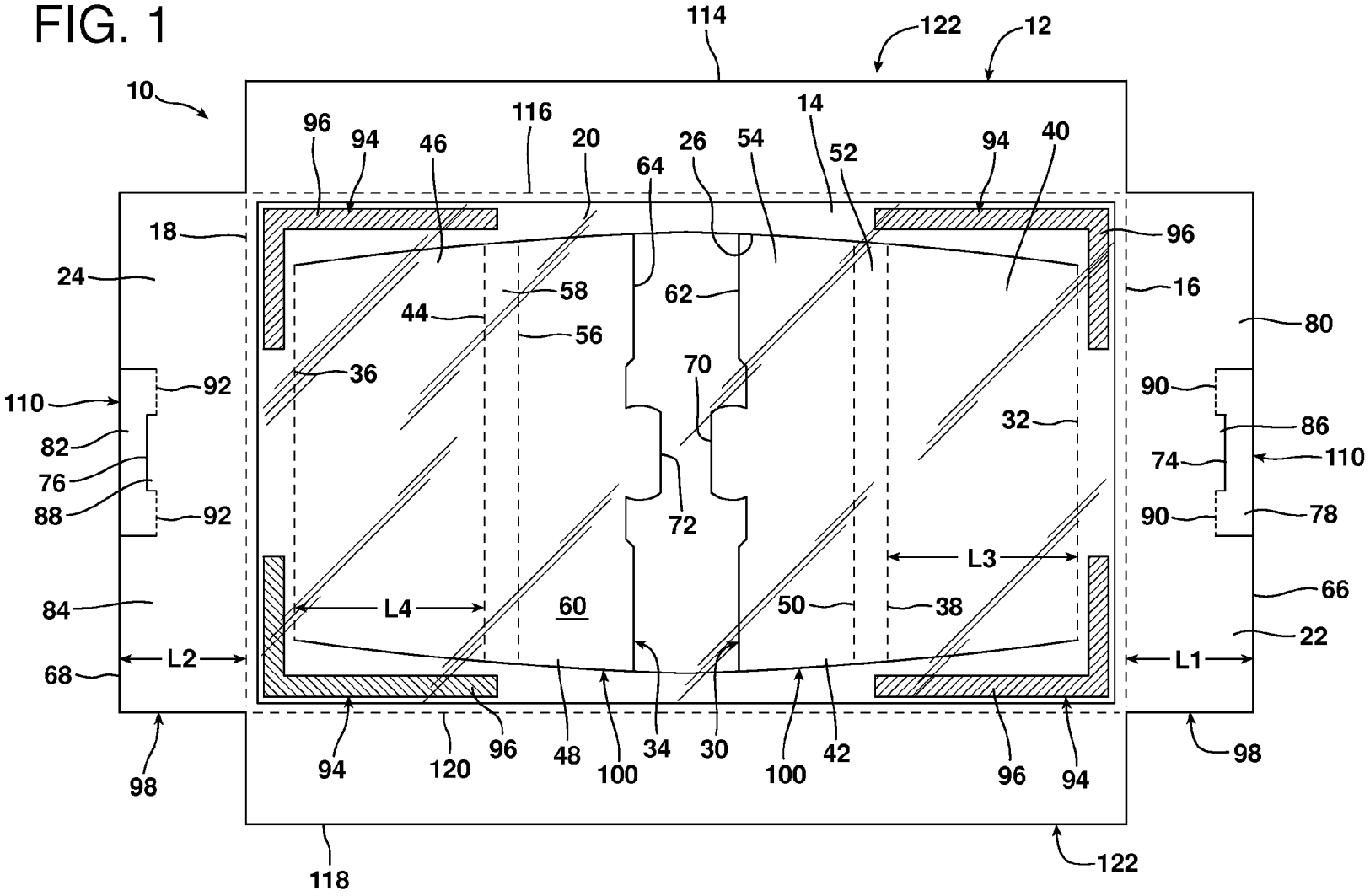
FIG. 1 is a representative top down view of the frame 10 embodiment having first and second primary leg flaps 22, 24 in the unfolded position 98, first and second side flaps 114, 118 in the unfolded position 122, first and second auxiliary leg flaps 30, 34 in the disengaged position 100.
Figure 2:
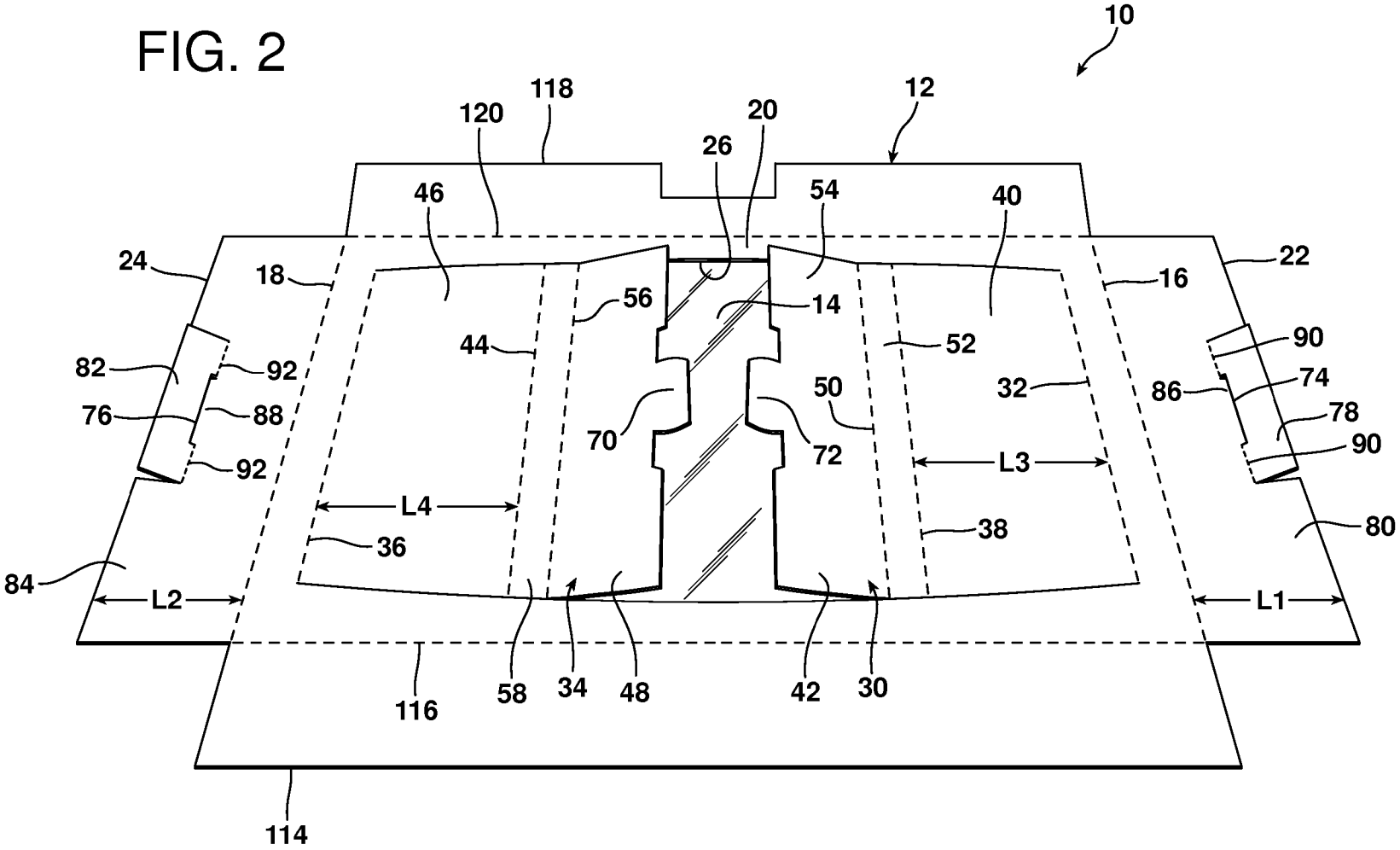
FIG. 2 is a representative perspective view of the flip side of frame 10 of FIG. 1.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

In an embodiment of the invention, packaging frame 10 comprises sheet 14 attached to panel 12. (FIG. 1.)

Panel

Panel 12 has a first fold line 16 and a second fold line 18 that oppose each other to delineate, or separate panel 12 into, (i) a central portion 20 between the first and second fold lines, (ii) a first primary leg flap 22 extending from first primary fold line 16, and (iii) a second primary leg flap 24 extending from the second fold line 18.

The first primary leg flap 22 has a given length "L1" taken from the first fold line 16 to the outer edge 66 of the first primary leg flap 22 opposite first fold line 16, as illustrated in FIG. 1. The second primary leg flap 24 has a given length "L2" taken from the second fold line 18 to the outer edge 68 of the second primary leg flap 24 opposite second fold line 18, as illustrated in FIG. 1. The L1 measurement is made generally perpendicular to the first fold line; the L2 measurement is made generally perpendicular to the second fold line.

A "fold line" as used herein (and as depicted in the drawings as a broken line, for example as in FIG. 1) represents a line along which a panel, frame, or other material may be creased, crimped, embossed, perforated, scored, or otherwise weakened so as to enhance the foldability of the panel, frame, or other material along the fold line. For example, first fold line 16 may include one or more through slits (not shown) extending partially along its length, leaving a sufficient portion of the fold line intact to securely join first primary leg flap 22 to the central portion 20 of panel 12 so that first primary leg flap 22 is foldably connected to the central portion 20. The slits through the fold line may facilitate folding the first primary leg flap along the first fold line 16 by reducing the amount of panel material that has to be folded.

Figure 12:
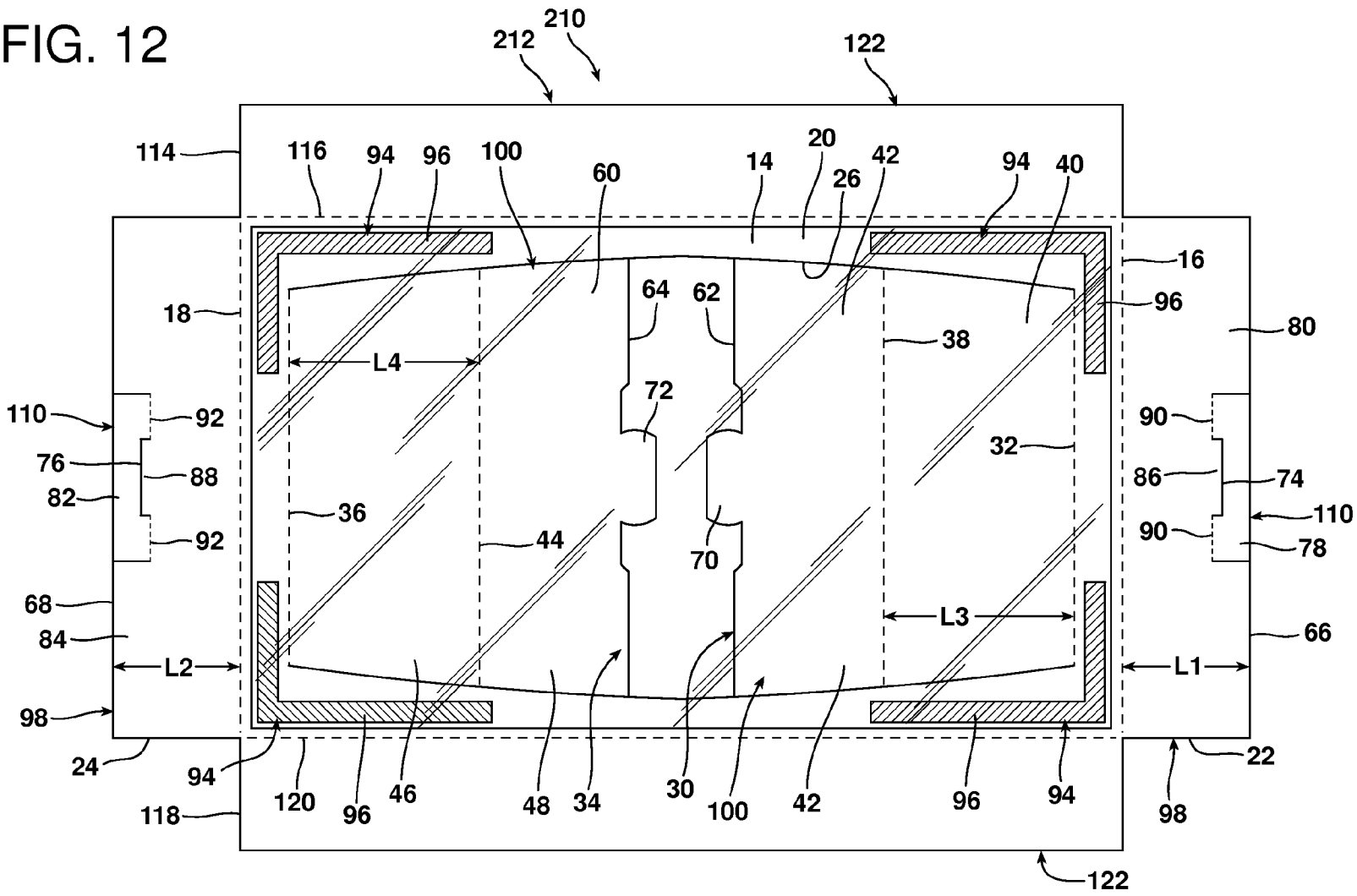
FIG. 12 is a representative top down view of the alternative embodiment frame 210.

First primary leg flap 22 may define first slot 74 for receiving first locking tab 70 as discussed below. First slot 74 may be non-linear, for example as shown in FIGS. 1 and 12, to define first backstop protuberance 86. First primary leg flap 22 may comprise (i) first slot flap 78 adjacent the first slot 74 and foldable along first slot flap fold lines 90 adjacent the first slot 74 and (ii) first non-slot flap remainder portion 80 outside of the first slot flap 78.

Second primary leg flap 24 may define second slot 76 for receiving second locking tab 72 as discussed below. Second slot 76 may be non-linear, for example as shown in FIGS. 1 and 12, to define second backstop protuberance 88. Second primary leg flap 24 may comprise (i) second slot flap 82 adjacent the second slot 76 and foldable along second slot flap fold lines 92 adjacent the second slot 76 and (ii) second non-slot flap remainder portion 84 outside of the second slot flap 82.

Central portion 20 of panel 12 defines panel opening 26. Panel opening 26 may be larger than the product 28 to be packaged (shown, e.g., in FIG. 8), that is, a panel opening large enough that the packaged product 28 could pass through the panel opening 26 if the sheet 14 were not present.

Panel 12 comprises first auxiliary leg flap 30 foldably connected to the central portion 20 along third fold line 32. Panel 12 comprises second auxiliary leg flap 34 foldably connected to the central portion 20 along fifth fold line 36. As such, the perimeter of panel opening 26 may be defined at least in part by the third and fifth fold lines along which the first and second auxiliary leg flaps, respectively, are foldably connected.

The third fold line 32 is generally parallel to the first fold line 16. The fifth fold line 36 is generally parallel to second fold line 18. As used herein, the term "generally" when used in conjunction with terms such as "parallel" or "perpendicular" or "coplanar" is meant to indicate that the parallel or perpendicular or coplanar orientation does not require mathematical precision, but rather indicates a moderate range of deviation from absolute parallel or perpendicular or coplanar that is commonly acceptable as a level of accuracy for these terms within the container-folding field.

The first auxiliary leg flap 30 has a fourth fold line 38 generally parallel to the third fold line 32 and delineating the first auxiliary leg flap 30 into (i) a first proximal portion 40 between the third and fourth fold lines and (ii) a first distal portion 42 extending from the fourth fold line 38. Preferably the first proximal portion 40 does not comprise a fold line between the third fold line 32 and the fourth fold line 38. The first proximal portion 40 has a length "L3" taken from the third fold line 32 to the fourth fold line 38, as illustrated in FIG. 1. The L3 measurement is made generally perpendicular to the third fold line. The length L3 is greater than the length L1. The ratio of L3 to L1 may be at least any of the following: 1.2, 1.4, 1.6, 1.8, 2.0, 2.5, 3.0, and 4.0. The ratio of L3 to L1 may be at most any of the following: 6.0, 5.0, 4.0, 3.5, 3.0, 2.5, 2.0, 1.8, and 1.6.

The second auxiliary leg flap 34 has a sixth fold line 44 generally parallel to the fifth fold line 36 and delineating the second auxiliary leg flap 34 into (i) a second proximal portion 46 between the fifth and sixth fold lines and (ii) a second distal portion 48 extending from the sixth fold line 44. Preferably the second proximal portion 46 does not comprise a fold line between the fifth fold line 36 and the sixth fold line 44. The second proximal portion 46 has a length "L4" taken from the fifth fold line 36 to the sixth fold line 44, as illustrated in FIG. 1. The L4 measurement is made generally perpendicular to the fifth fold line. The length L4 is greater than the length L2. The ratio of L4 to L2 may be at least any of the following: 1.2, 1.4, 1.6, 1.8, 2.0, 2.5, 3.0, and 4.0. The ratio of L4 to L2 may be at most any of the following: 6.0, 5.0, 4.0, 3.5, 3.0, 2.5, 2.0, 1.8, and 1.6.

The first distal portion 42 may comprise a first locking tab 70, for example, located at the outer edge 62 of the first auxiliary leg flap opposite the third fold line 32. The second distal portion 48 may comprise a second locking tab 72, for example, located at the outer edge 64 of the second auxiliary leg flap opposite the fifth fold line 36.

For the embodiment of FIG. 1, the first distal portion 42 comprises a seventh fold line 50 generally parallel to the fourth fold line 38 and delineating the first distal portion 42 into first intermediate portion 52 and first remainder portion 54. The first intermediate portion 52 is between first remainder portion 54 and first proximal portion 40. Thus, in the embodiment of FIG. 1, the first auxiliary leg flap 30 comprises seventh fold line 50 between the fourth fold line 38 and the outer edge 62 of the first auxiliary leg flap 30 opposite the third fold line 32. Preferably, the first remainder portion 54 does not comprise a fold line.

Also for the embodiment of FIG. 1, the second distal portion 48 comprises an eighth fold line 56 generally parallel to the fourth fold line 38 and delineating the second distal portion 48 into second intermediate portion 58 and second remainder portion 60. The second intermediate portion 58 is between second remainder portion 60 and second proximal portion 46. Thus, in the embodiment of FIG. 1, the second auxiliary leg flap 34 comprises eighth fold line 56 between the sixth fold line 44 and the outer edge 64 of the second auxiliary leg flap 34 opposite the fifth fold line 36. Preferably, the second remainder portion 60 does not comprise a fold line.

Panel 12 may comprise first side flap 114 extending from and foldably connected to the central portion 20 by first side flap fold line 116. Panel 12 may further comprise second side flap 118 extending from and foldably connected to the central portion 20 by second side flap fold line 120. Either or both of the first side flap fold line 116 and the second side flap fold line 120 may be generally perpendicular to either or both of first fold line 16 and second fold line 18. The central panel portion 20 may be between the first and second side flap fold lines 116 and 120. The first and second fold lines 16, 18 and the first and second side flap fold lines 116, 120 may collectively bound (e.g., circumscribe) central panel portion 20 of panel 12.

Panel 12, and any of the panels and frames of the various embodiments described herein, may comprise a substantially rigid, lightweight, foldable material, for example, panel 12, or any of the portions of panel 12 described herein, may be formed of one or more of any of the following materials: cellulosic-based materials (e.g., cardboard, corrugated cardboard, paperboard), plastic, and compressed foam. For example, panel 12 may comprise corrugated cardboard, for example, any of single-wall B-flute, C-flute, and/or E-flute corrugated cardboard, B/C double-wall corrugated cardboard, and/or E/B double-wall corrugated cardboard. The panel, and any of the panels and frames of the various embodiments described herein, may have an average thickness of, for example, at most about, and/or at least about, any of the following thicknesses: 0.03, 0.06, 0.12, 0.18, 0.25, 0.3, 0.4, and 0.5 inches.

Sheet

Sheet 14 is attached to the panel 12 and extends over (i.e., across) the panel opening 26. In the drawings, sheet 14 is shown completely covering panel opening 26; in alternative embodiments the sheet may extend over the panel opening and only partially cover the panel opening (not illustrated). Sheet 14 may be attached to panel 12, for example to central portion 20 that defines panel opening 26, by any of the ways described herein. In the drawings, sheet 14 is shown attached to the panel 12 by adhering with adhesive 96; however, the sheet may be attached to the panel, for example, by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein.

Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

In the drawings, sheet 14 is attached to panel 12 along attachment zone 94 comprising adhesive 96. As shown, attachment zone 94 is discontinuous or periodic, having attachment areas corresponding to the corner regions of the central portion 20 of the panel 12. However, attachment zone 94 may extend continuously (not illustrated) to circumscribe or surround the entirety of panel opening 26.

Sheet 14, and any of the sheets of the various embodiments described herein, may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

Sheet 14 may have a composition and thickness providing acceptable performance properties (e.g., flexibility, elasticity, optics, strength) for the given packaging application of expected use. The sheet may have a thickness of at most any of the following: 10 mils, 6 mils, 5 mils, 4 mils, 3 mils, 2 mils, 1.5 mils, and 1 mil. (A "mil" is equal to 0.001 inch.) The sheet may also have a thickness of at least any of the following: 0.5 mils, 1 mil, 1.5 mils, 2 mils, and 3 mils.

The sheet may have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

The sheet may have a maximum load tear resistance in either or both of the transverse and longitudinal directions of at least any of the following values: 400, 450, 500, 550, and 600 grams force, measured according to ASTM D1004.

The sheet may have a slow puncture maximum load of at least any of the following values: 4, 4.5, 5, 5.5, 6, 6.5, and 7 pounds force, measured according to ASTM F1306 using a crosshead speed of 5 inches per minute.

The sheet may have a Young's modulus sufficient to withstand the expected handling and use conditions, yet may provide a "soft" feel that may be desirable for a packaging application. The sheet may have a Young's modulus of at least any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

The sheet may be transparent so that the packaged article (e.g., product 28) may be visible through the sheet. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

The sheet may have a heat-shrink attribute. For example, the sheet may have any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. Alternatively, the sheet may be non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The sheet may comprise, for example, one or more fabrics, such as one or more of the following: wovens, knits, nonwovens, and openwork meshes (e.g., netting), spandex, including Lycra® brand spandex, and elastic fabrics.

The sheet may comprise one or more polymers, for example, one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth) acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). The sheet may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

A sheet comprising polyolefin (e.g., polyethylene), polyvinyl chloride, and/or polyurethane may be useful for lightweight applications, for example, where a sheet thickness of from 2 to 4 mils may be desirable. A sheet comprising polyurethane may provide desirable elastomeric, puncture resistance, temperature resistance, and tackiness characteristics.

The sheet may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

The sheet may be manufactured by thermoplastic film-forming processes known in the art (e.g., tubular or blown-film extrusion, coextrusion, extrusion coating, flat or cast film extrusion). A combination of these processes may also be employed.

At least one side of the sheet may be corona and/or plasma treated to change the surface energy of the sheet, for example, to increase the ability of the sheet to adhere to a panel or frame.

Films that may be useful as sheets are described in U.S. Pat. No. 6,913,147 issued Jul. 5, 2005 and entitled "Packaging Structure Having a Frame and Film," which is incorporated herein in its entirety by reference.

Manufacture

By using types of machinery well known to those of skill in the field, panel 12 may be cut to the desired shapes and provided with fold lines or lines of detachability, using the known types of machinery, for example, to slit, crease, crimp, emboss, perforate, scored, or otherwise weaken the panel in desired regions. Adhesive 96 may be applied to the panel 12 in selected areas, for example, the attachment zones 94 (FIGS. 1 and 12). The sheet 14 may be attached to the panel 12 by laminating or adhering the sheet with adhesive 30 to the panel. The sheet material may be provided in roll form, unrolled, and then cut to the desired length and width either before or after attachment to the panel.

Use

Frame 10 may be provided in a lay-flat configuration, as shown in FIG. 1. The first primary leg flap 22 and the second primary leg flap 24 are each in an unfolded position 98 each generally coplanar with the central portion 20. Further, the first auxiliary leg flap 30 and the second auxiliary leg flap 34 are each in a disengaged position 100 extending into panel opening 26. First and second side flaps 114, 118 are each in an unfolded position 122 each generally coplanar with the central portion 20. Such configurations may facilitate the provision of multiple frames in a convenient stacked or bundled arrangement (not illustrated).

Figure 3:
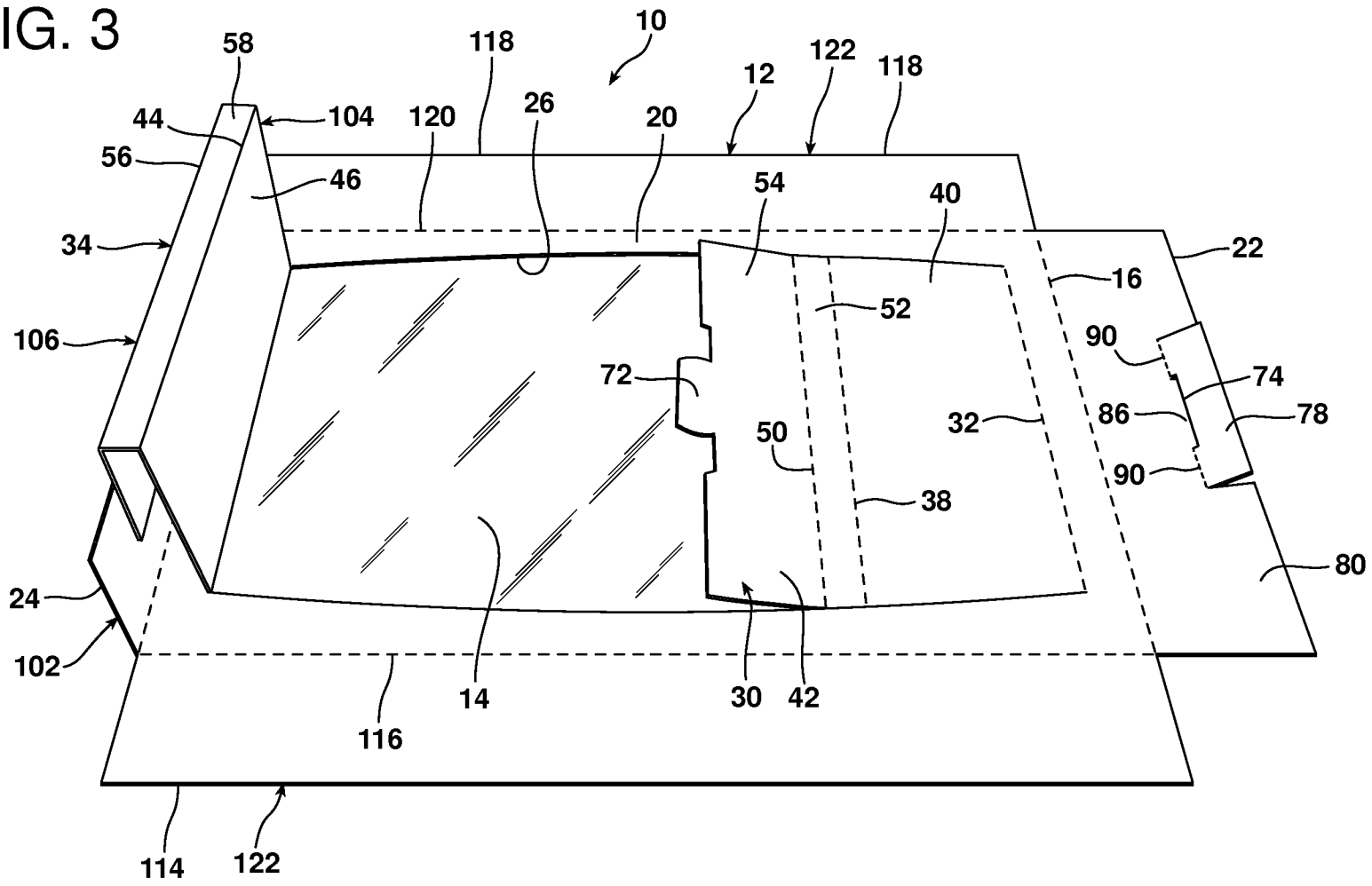
FIG. 3 is a representative perspective view of the frame 10 of FIG. 2 but having the second auxiliary leg flap 34 in the engaged position 104 with second primary leg flap 24 in the folded position 102 rendering second leg assembly 106.
Figure 4:
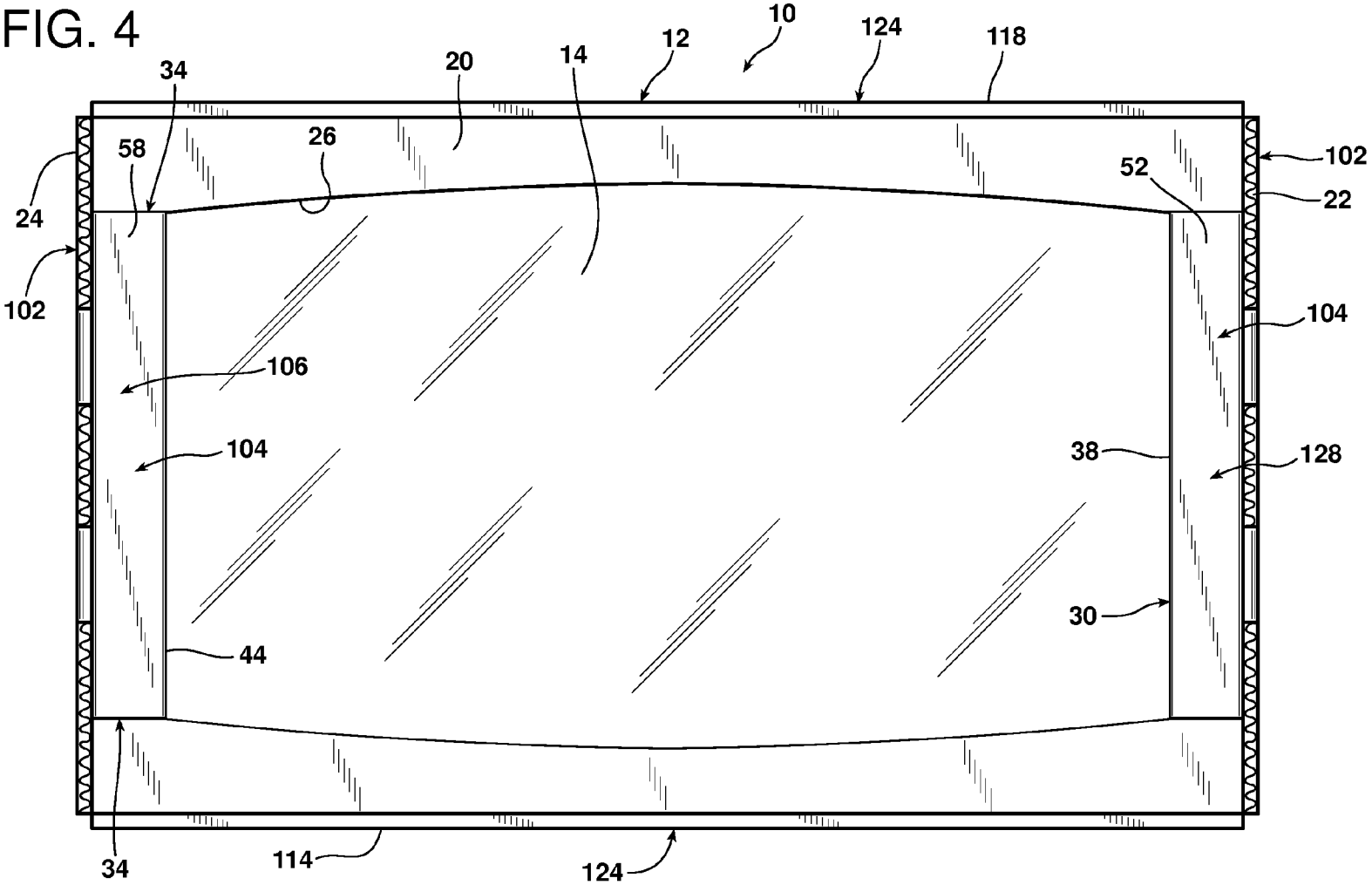
FIG. 4 is a representative top down view of the frame 10 of FIG. 3, but having the first auxiliary leg flap 30 in the engaged position 104 with first primary leg flap 22 in the folded position 102 rendering first leg assembly 128 and having first and second side flaps 114, 118 in the folded position 124.
Figure 6:
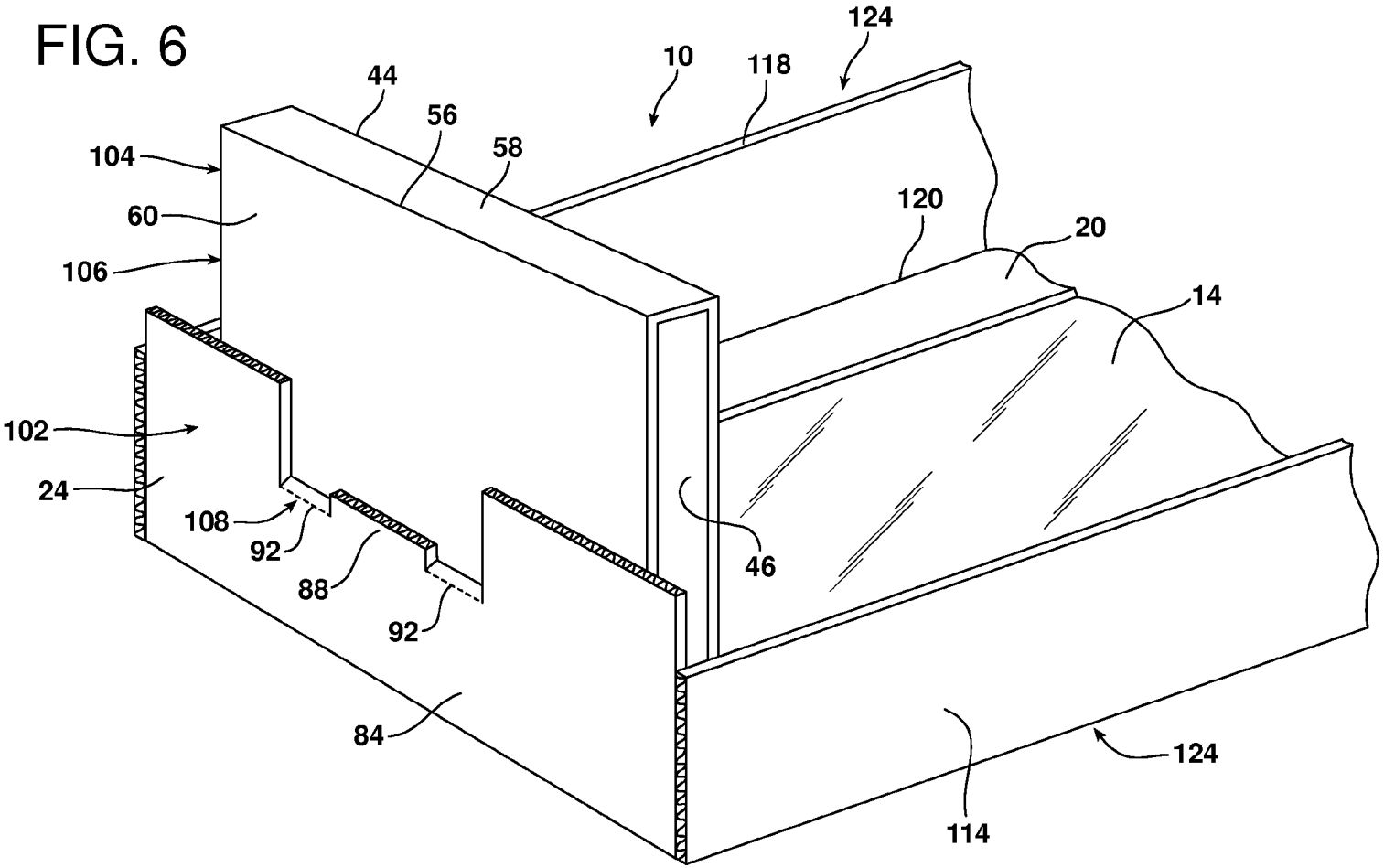
FIG. 6 is a representative perspective partial view of the frame of FIG. 4.
Figure 10:
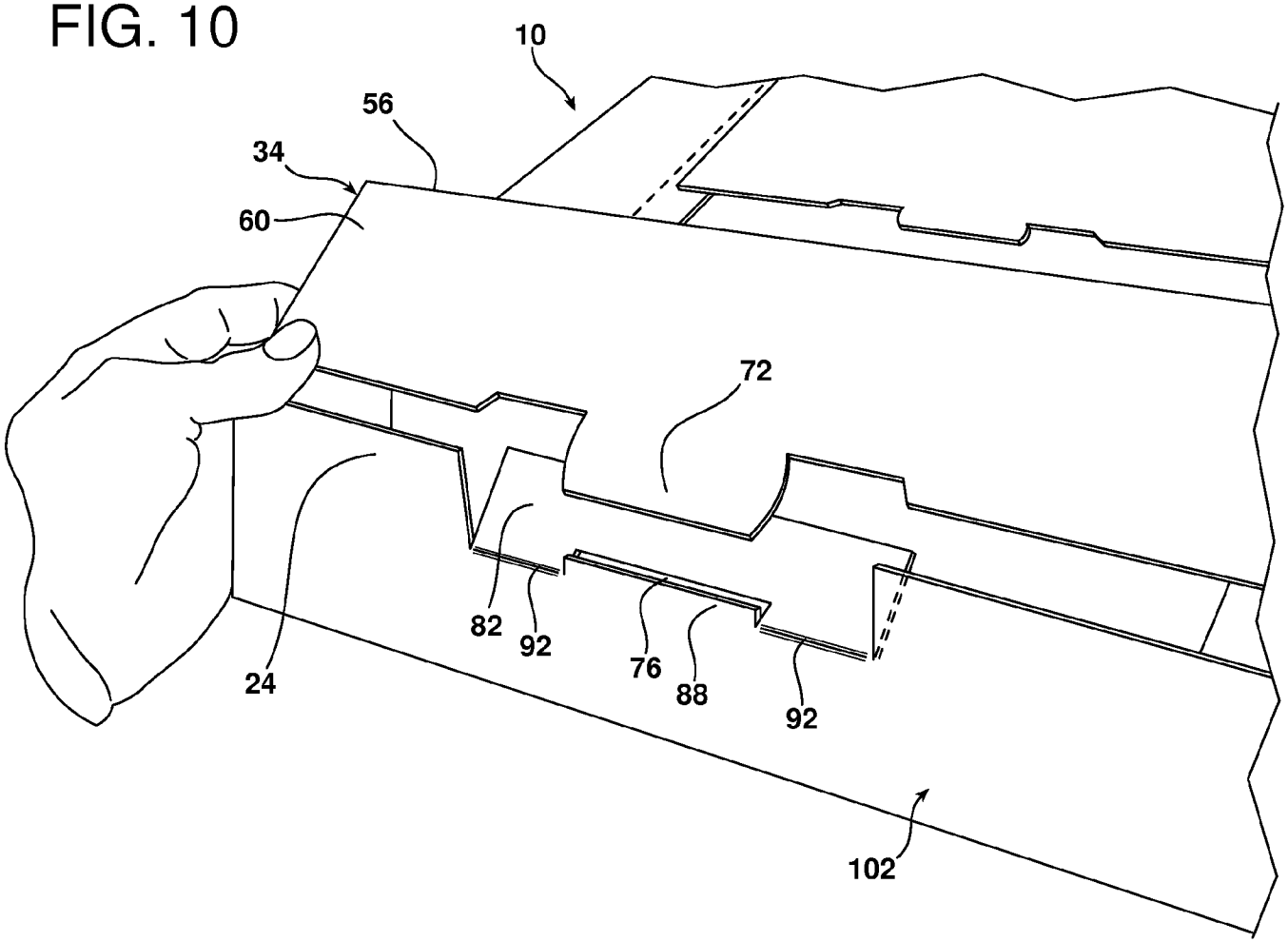
FIG. 10 is a representative perspective partial detail view of frame 10 showing an intermediate position of the second auxiliary leg flap 34 transitioning from a disengaged position to the engaged position shown in FIG. 11.
Figure 11:
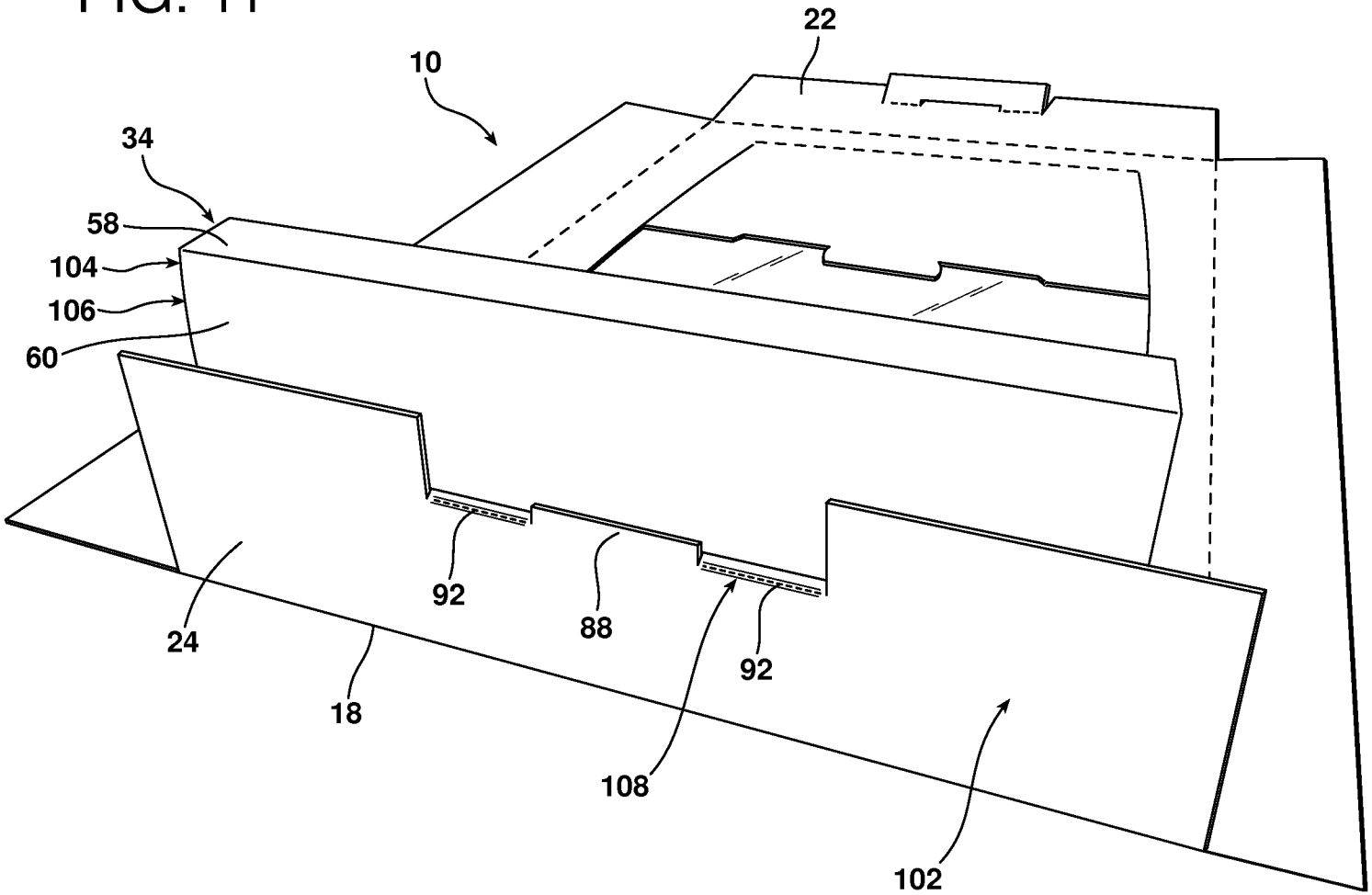
FIG. 11 is a representative perspective partial view of frame 10 showing second leg assembly 106 having the second auxiliary leg flap 34 in engaged position 104.

FIGS. 3, 6, and 11 show frame 10 having the second primary leg flap 24 in a folded position 102 extending from the plane of the central portion 20 by folding the second primary leg flap 24 along second fold line 18. Second auxiliary leg flap 34 is placed in an engaged position 104 in which the second auxiliary leg flap 34 extends from the plane of the central portion 20 to engage the second primary leg flap 24 in the folded position 102 to create the second leg assembly 106. (FIGS. 3, 6, and 11.) In more detail for this embodiment, second proximal portion 46 extends from the plane of the central portion 20 and the second distal portion 48 (in particular, the second remainder portion 60) engages the second primary leg flap 24. "Engage" in this context connotes that the second primary leg flap 24 and the second auxiliary leg flap 34 fixedly contact each other to enable the transfer of load from one member to the other. In the illustrated embodiments, this is done by folding the second auxiliary leg flap 34 along fifth fold line 36, sixth fold line 44, and eighth fold line 56, and inserting second locking tab 72 into second slot 76 of the second primary leg flap 24 (FIG. 10) so that the second slot receives the second locking tab 72 in interlocking engagement 108 to create the second leg assembly 106 (FIG. 11). Ways of engagement of second primary leg flap 24 and second auxiliary leg flap 34 other than the illustrated interlocking engagement of the tab/slot include the use of multiple tab/slot interlocking engagements and/or one or more of adhesives (e.g., tape) and hook-and-loop fastening system (e.g., Velcro brand). An advantage of the interlocking engagement of tab/slot configuration is that it facilitates the correct positioning of the primary and auxiliary leg flaps relative each other during assembly.

The second leg assembly 106 has a given height "H2" (FIG. 5) taken perpendicular to the plane of the central portion 20 and from the top surface of the central portion 20 to the top edge (e.g., at fold line 44) of second leg assembly 106. The height H2 of the second leg assembly is greater than the length L2 of the second primary leg flap 24. The ratio of H2 to L2 may be at least any of the following: 1.2, 1.4, 1.6, 1.8, 2.0, 2.5, 3.0, and 4.0. The ratio of H2 to L2 may be at most any of the following: 6.0, 5.0, 4.0, 3.5, 3.0, 2.5, 2.0, 1.8, and 1.6.

Figure 5:
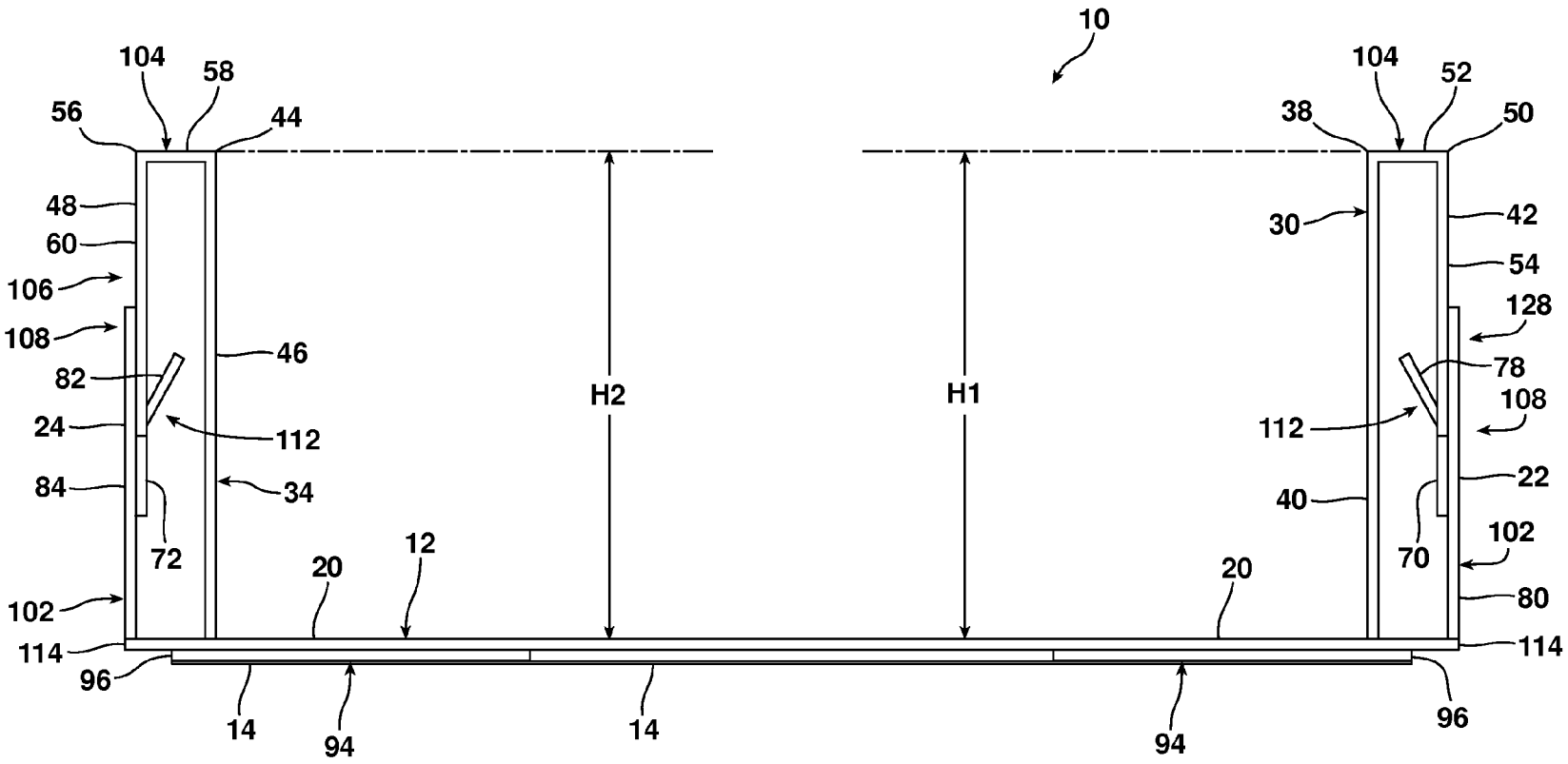
FIG. 5 is a representative elevation side view of the frame 10 of FIG. 4, but having first and second side flaps 114, 118 in the unfolded position 122.

In the engaged position 104 of the second auxiliary leg flap 34 of, for example, the embodiment of FIGS. 5 and 6, the plane of the second intermediate portion 58 is generally parallel to the plane of the central portion 20. Accordingly in this embodiment, the second intermediate portion 58 of the resulting second leg assembly 106 is generally parallel to the plane of the central portion 20. This arrangement facilitates the stability of the frame when positioned in box 126 (discussed below) and provides the area of second intermediate portion 58 over which to spread a load transferred from the central portion 20 along the second proximal portion 46 and the engaged second remainder portion 60 and second primary leg flap 24. Further, for this embodiment, in the engaged position 104 of the second auxiliary leg flap 34, the plane of second proximal portion 46 may be generally perpendicular to the plane of central portion 20.

In more detail regarding the interlocking engagement illustrated in the drawings, the second slot flap 82 is folded from a disengaged position 110 (FIGS. 1 and 12), in which the second slot flap is generally coplanar with the second non-slot flap remainder portion 84, along second slot flap fold lines 92, to an engaged position 112 (FIGS. 5-6 and 13), in which the second slot flap 82 extends from the plane of the second non-slot flap remainder portion 84. This facilitates access to the second slot 76 for insertion of the second locking tab 72. In the illustrated embodiments of FIGS. 5 and 6, the second slot flap 82 is folded toward the interior of the frame while the second primary leg flap 24 is in the folded position 102 so that a section (i.e., second remainder portion 60) of the second distal portion 48 is between the second slot flap 82 and the second non-slot flap remainder portion 84 when the second auxiliary leg flap is in the engaged position 104. Although not illustrated, the same arrangement of having a section of the second remainder portion 60 of the second distal portion 48 between the second slot flap 82 and the second non-slot flap remainder portion 84 when the second auxiliary leg flap is in the engaged position 104 can also be achieved by having the second slot flap 82 folded away from the interior of the frame while the second primary leg flap 24 is in the folded position 102. In either case, the second backstop protuberance 88 facilitates guiding the second locking tab 72 into the second slot 76.

Figure 9:
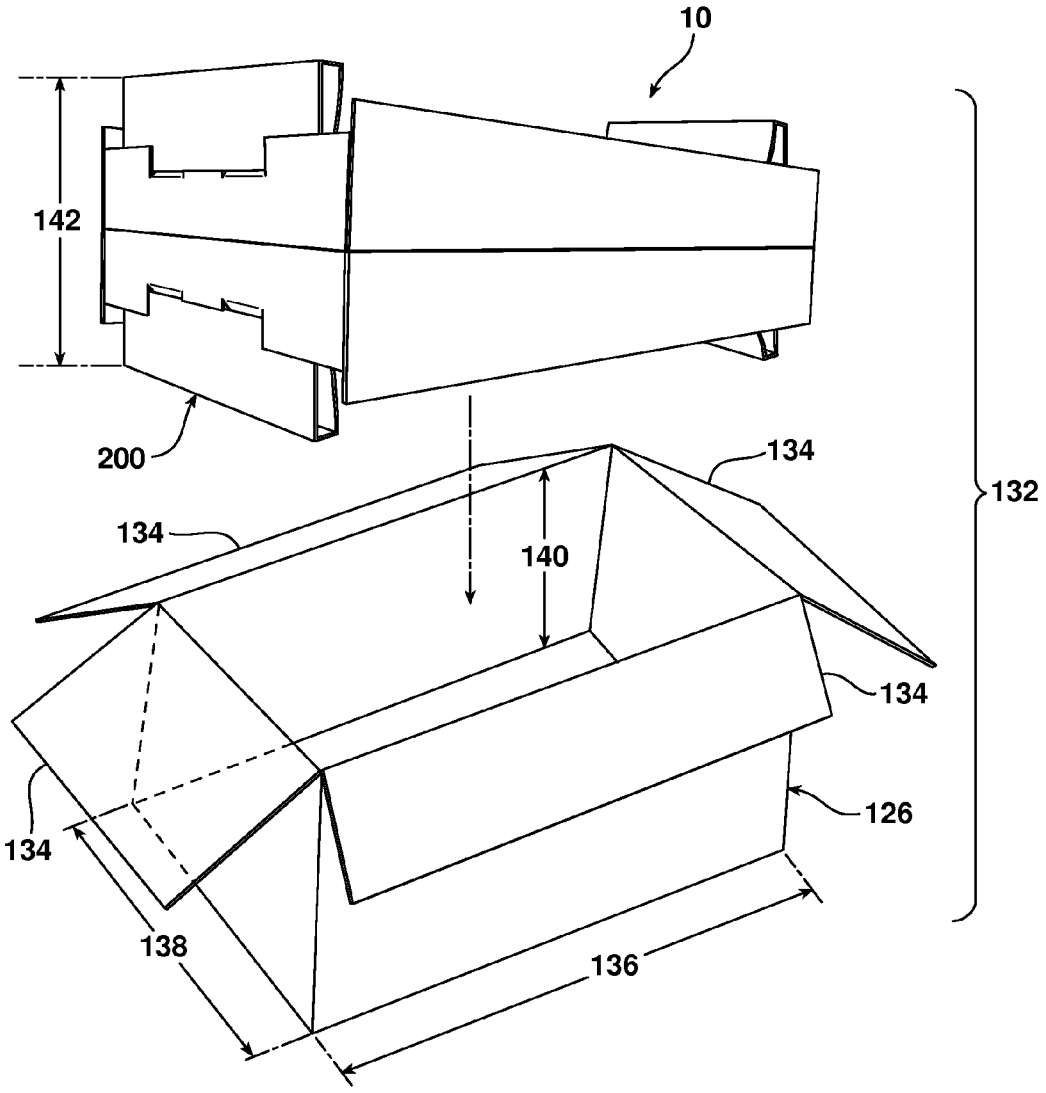
FIG. 9 is a representative perspective view of packaging assembly 132 having opposing suspension frames 10, 200 and box 126.

The creation of first leg assembly 128 (FIGS. 5 and 9) is much the same as its counterpart second leg assembly 106, and therefore is illustrated in the drawings in lesser detail. The first primary leg flap 22 is placed in a folded position 102 extending from the plane of the central portion 20 by folding the first primary leg flap 22 along first fold line 16. First auxiliary leg flap 30 is placed in an engaged position 104 in which the first auxiliary leg flap 30 extends from the plane of the central portion 20 to engage the first primary leg flap 22 in the folded position 102 to create the first leg assembly 128. (FIGS. 5 and 9.) In more detail for this embodiment, first proximal portion 40 extends from the plane of the central portion 20 and the first distal portion 42 (e.g., the first remainder portion 54) engages the first primary leg flap 22. "Engage" in this context is the same as that described above in connection with the second leg assembly. In the illustrated embodiments, the engagement is made by folding the first auxiliary leg flap 30 along third fold line 32, fourth fold line 38, and seventh fold line 50, and inserting first locking tab 70 into first slot 74 of the first primary leg flap 22 so that the first slot receives the first locking tab 70 in interlocking engagement 108 to create the first leg assembly 128. Alternative ways of engagement of first primary leg flap 22 and first auxiliary leg flap 30 other than the illustrated interlocking engagement of the tab/slot are the same as that discussed above with respect to the second leg assembly 106.

The first leg assembly 128 has a given height "H1" (FIG. 5) taken perpendicular to the plane of the central portion 20 and from the top surface of the central portion 20 to the top edge (e.g., at fold line 38) of first leg assembly 128. The height H1 of the first leg assembly is greater than the length L1 of the first primary leg flap 22. The ratio of H1 to L1 may be at least any of the following: 1.2, 1.4, 1.6, 1.8, 2.0, 2.5, 3.0, and 4.0. The ratio of H1 to L1 may be at most any of the following: 6.0, 5.0, 4.0, 3.5, 3.0, 2.5, 2.0, 1.8, and 1.6.

In the engaged position 104 of the first auxiliary leg flap 30 of, for example, the embodiment of FIGS. 5 and 9, the plane of the first intermediate portion 52 is generally parallel to the plane of the central portion 20. Accordingly in this embodiment, the first intermediate portion 52 of the resulting first leg assembly 128 is generally parallel to the plane of the central portion 20. This arrangement facilitates the stability of the frame when positioned in box 126 (discussed below) and provides the area of first intermediate portion 52 over which to spread a load transferred from the central portion 20 along (i) the first proximal portion 40 and (ii) the engaged first remainder portion 54 and first primary leg flap 22. Further, for this embodiment, in the engaged position 104 of the first auxiliary leg flap 30, the plane of first proximal portion 40 may be generally perpendicular to the plane of central portion 20.

In more detail regarding the interlocking engagement illustrated in the drawings, the first slot flap 78 is folded from a disengaged position 110 (FIG. 1), in which the first slot flap is generally coplanar with the first non-slot flap remainder portion 80, along first slot flap fold lines 90, to an engaged position 112 (FIG. 5), in which the first slot flap 78 extends from the plane of the first non-slot flap remainder portion 80. This facilitates access to the first slot 74 for insertion of the first locking tab 70. In the illustrated embodiment of FIG. 5, the first slot flap 78 is folded toward the interior of the frame while the first primary leg flap 22 is in the folded position 102 so that a section of the first remainder portion 54 of the first distal portion 42 is between the first slot flap 78 and the first non-slot flap remainder portion 80 when the first auxiliary leg flap is in the engaged position 104. Although not illustrated, the same arrangement of having a section (i.e., first remainder portion 54) of the first distal portion 42 between the first slot flap 78 and the first non-slot flap remainder portion 80 when the first auxiliary leg flap is in the engaged position 104 can also be achieved by having the first slot flap 78 folded away from the interior of the frame while the first primary leg flap 22 is in the folded position 102. In either case, the first backstop protuberance 86 facilitates guiding the first locking tab 70 into the first slot 74.

The features of the interlocking engagement illustrated in the drawings may be reversed or swapped for an alternative arrangement. For example, in an alternative arrangement (not illustrated) first primary leg flap 22 may comprise a first locking tab similar to element 70; and the first distal portion 42 may define a first slot similar to element 74 for receiving the first locking tab in interlocking engagement when the first auxiliary leg flap is in the engaged position. In such alternative arrangement, the first distal portion 42 may also comprise (i) a foldable first slot flap similar to element 78, adjacent the first slot and (ii) a first non-slot flap remainder portion of the first distal portion 42 outside of the first slot flap.

Continuing in this alternative arrangement (not illustrated) second primary leg flap 24 may comprise a second locking tab similar to element 72; and the second distal portion 48 may define a second slot similar to element 76 for receiving the second locking tab in interlocking engagement when the second auxiliary leg flap is in the engaged position. In such alternative arrangement, the second distal portion 48 may also comprise (i) a foldable second slot flap similar to element 82, adjacent the second slot and (ii) a second non-slot flap remainder portion of the second distal portion 48 outside of the second slot flap.

In this alternative arrangement (not illustrated) of interlocking engagement features, the disengaged and engaged positions of the first and second slot flaps are similar to that described in conjunction with the embodiments illustrated in the drawings, and therefore the descriptions are not repeated here. For this alternative arrangement, when the first auxiliary leg flap is in the engaged position, a section of the first primary leg flap may be between the first slot flap and the first non-slot flap remainder portion. Likewise for this alternative arrangement, when the second auxiliary leg flap is in the engaged position, a section of the second primary leg flap may be between the second slot flap and the second non-slot flap remainder portion.

FIGS. 6 to 9 show frame 10 having first and second side flaps 114, 118 in a folded position 124 extending from the plane of the central portion 20 by folding the first and second side flaps 114, 118 along first and second side flap fold lines 116, 120, respectively. As illustrated in the embodiment of FIGS. 6 to 9, the plane of the first and second side flaps 114, 118 in the folded position 124 may be generally perpendicular to the plane of the central portion 20 to facilitate insertion of the frame 10 into box 126 (discussed below)

Figure 7:
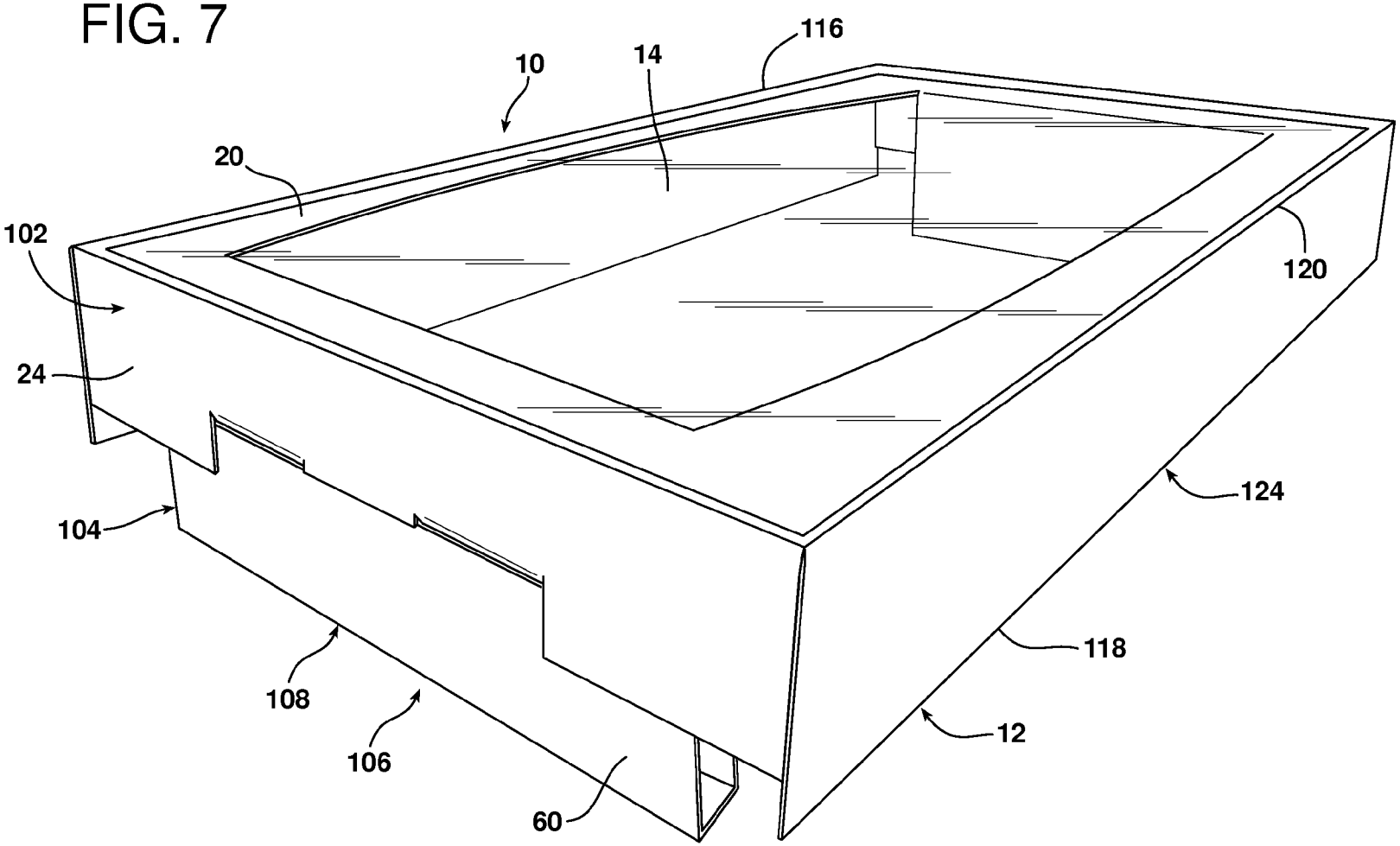
FIG. 7 is a representative perspective view of the flip side of the frame of FIG. 4.

FIG. 7 illustrates first suspension frame 10 having the second primary leg flap 24 in the folded position 102 and second auxiliary leg flap 34 in the engaged position 104 to create the second leg assembly 106. The first primary leg flap 22 (not visible) is in the folded position 102 and the first auxiliary leg flap 30 (not visible) is in the engaged position 104 to create the first leg assembly 128 (not visible in FIG. 7).

Figure 8:
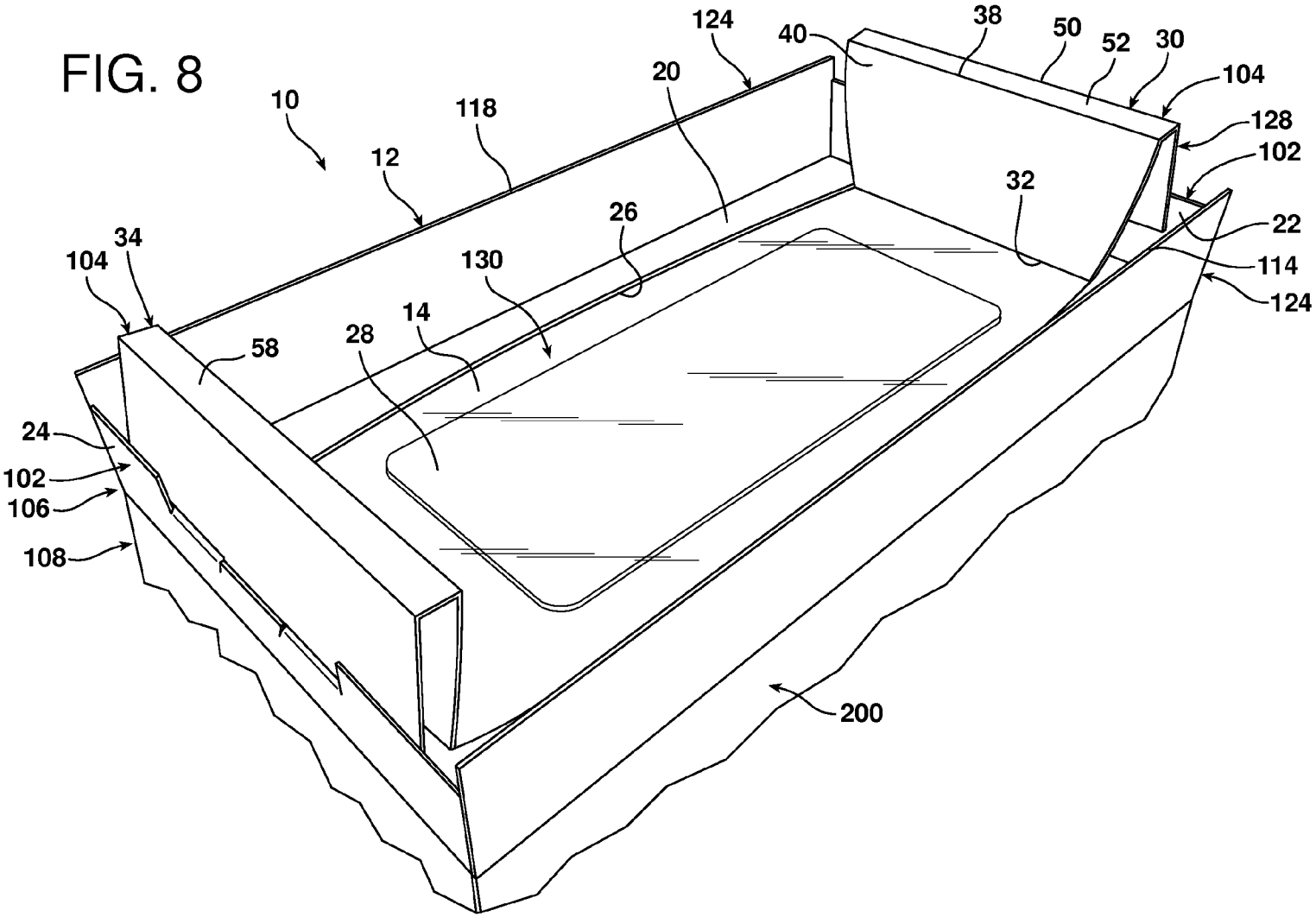
FIG. 8 is a representative perspective view of first suspension frame 10 opposing second suspension frame 200 to suspend product 28.

FIG. 8 illustrates first suspension frame 10 opposing a second suspension frame 200 to create a product suspension region 130 for suspending product 28 between the first and second suspension frames, more specifically, for product 28 suspended between sheet 14 of first suspension frame 10 and the opposing sheet of second suspension frame 200 (not visible). The first primary leg flap 22 is in the folded position 102 and the first auxiliary leg flap 30 is in the engaged position 104 to create the first leg assembly 128. The second primary leg flap 24 is in the folded position 102 and the second auxiliary leg flap 34 is in the engaged position 104 to create the second leg assembly 106. First and second side flaps 114, 118 are in the folded position 124.

FIG. 9 illustrates packaging assembly 132. First suspension frame 10 (in the folded and engaged positions) is in opposed arrangement with second suspension frame 200. In the illustrated packaging assembly 132 of FIG. 9, second suspension frame 200 is essentially a duplicate of first suspension frame 10; however, in other embodiments the second suspension frame can be a different design or arrangement from that of first suspension frame 10. Product 28 (not visible) is suspended between the first and second suspension frames.

Box 126 has interior dimensions corresponding with the opposing suspension frames (in the folded and engaged positions) that are in opposed arrangement to each other, as illustrated in FIG. 9. For example, box 126 may have: (a) an interior length 136 corresponding to the distance between the first and second fold lines 16, 18 of frame 10; (b) an interior width 138 corresponding to the distance between the first and second side flap fold lines 116, 120 of frame 10; and (c) an interior height 140 corresponding to the height 142 of the two opposing suspension frames 10, 200 (in the folded and engaged positions) that are in opposed arrangement to each other.

The opposing suspension frames suspending product 28 are placed within box 126 to contain the opposing suspension frames 10, 200 suspending product 28 within the box 126. Closure flaps 134 of box 126 may be closed to contain and maintain the suspension frames 10, 200 in opposed arrangement. Box 126 as illustrated comprises a polyhedron-shaped storage compartment, in which the side panels, bottom, and closure flaps are polygon-shaped (e.g., rectangular). Useful box types are known to those of skill in the field, and include containers of the RSC (regular slotted container) type, RELF (roll end lock front) type, RETT (roll and end tuck top) type, and STE (standard tuck end) type.

Figure 13:
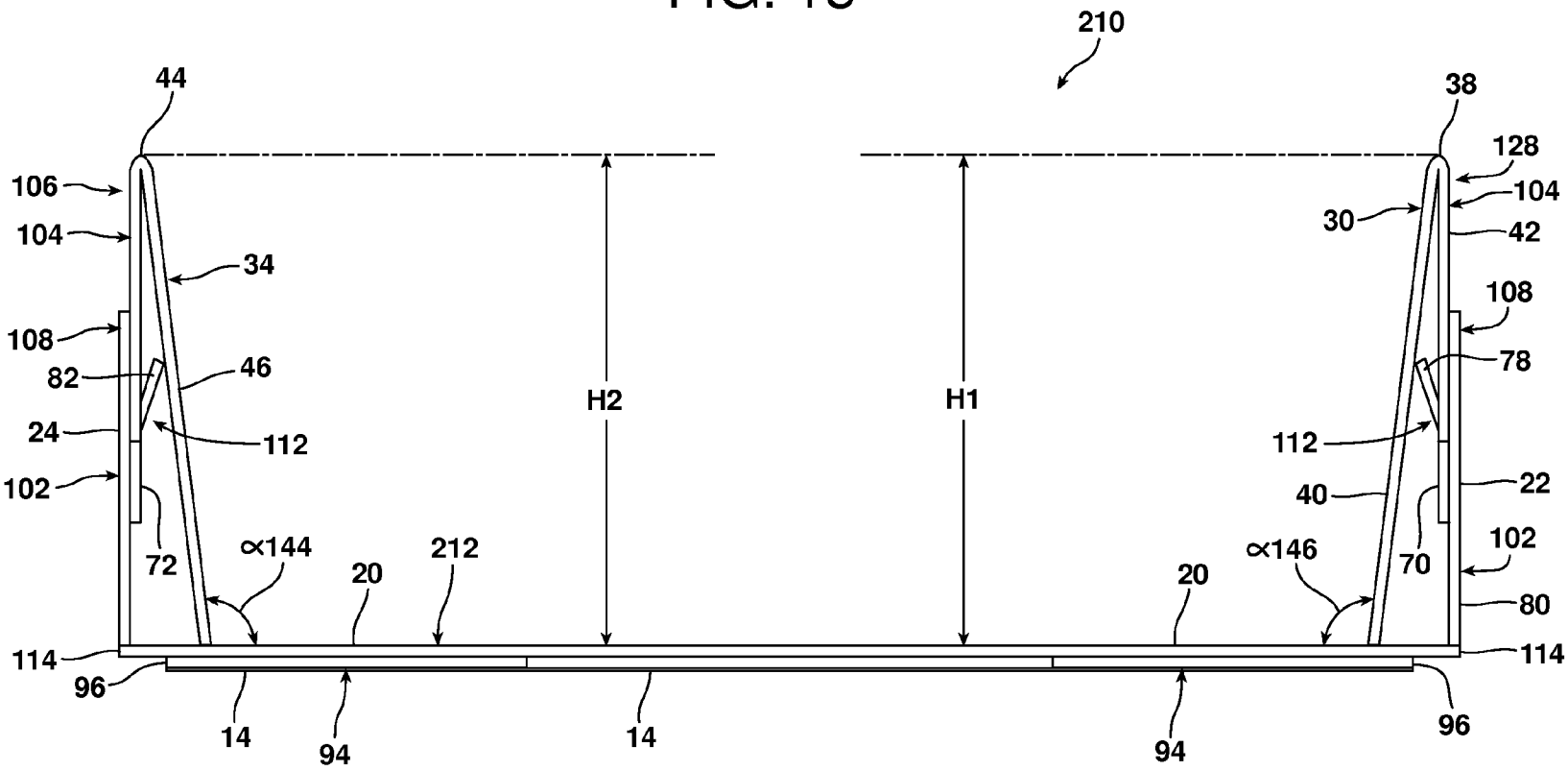
FIG. 13 is a representative elevation side view of the alternative embodiment frame 210, similar to the view of FIG. 5 of frame 10, having (i) first auxiliary leg flaps 30 in the engaged position 104 with first primary leg flap 22 in the folded position 102 rendering first leg assembly 128, (ii) second auxiliary leg flap 34 in the engaged position 104 with second primary leg flap 24 in the folded position 102 rendering second leg assembly 106, and (iii) first and second side flaps 114, 118 in the unfolded position 122.

Embodiment of FIGS. 12 to 13

In an embodiment of the invention, packaging frame 10 comprises sheet 14 attached to panel 12. (FIG. 1.)

An embodiment of the invention illustrated in FIGS. 12 to 13, packaging frame 210 comprises sheet 14 attached to panel 212. Frame 210 is similar to frame 10 of the embodiments illustrated in FIGS. 1 to 11 except as noted herein. The first distal portion 42 of panel 212 of frame 210 preferably does not comprise a fold line. Stated another way, the first auxiliary leg flap 30 does not comprise a fold line between the fourth fold line 38 and the edge of the first auxiliary leg flap 30 opposite the third fold line 32. Similarly, the second distal portion 48 preferably does not comprise a fold line.

Stated another way, the second auxiliary leg flap 34 does not comprise a fold line between the sixth fold line 44 and the edge of the second auxiliary leg flap 34 opposite the fifth fold line 36.

As with frame 10, frame 210 may be provided in a lay-flat configuration, as shown in FIG. 12. FIG. 13 shows frame 210 having the second primary leg flap 24 in a folded position 102 extending from the plane of the central portion 20 by folding the second primary leg flap 24 along second fold line 18. Second auxiliary leg flap 34 is placed in an engaged position 104 in which the second auxiliary leg flap 34 extends from the plane of the central portion 20 to engage the second primary leg flap 24 in the folded position 102 to create the second leg assembly 106. (FIG. 13.) In more detail for this embodiment, second proximal portion 46 extends from the plane of the central portion 20 and the second distal portion 48 engages the second primary leg flap 24. In the illustrated embodiment, this is done by folding the second auxiliary leg flap 34 along fifth fold line 36 and sixth fold line 44 and inserting second locking tab 72 into second slot 76 of the second primary leg flap 24 so that the second slot receives the second locking tab 72 in interlocking engagement 108 to create the second leg assembly 106 (FIG. 13). Details regarding the interlocking engagements for this embodiment are similar to that discussed above, and therefore is not repeated here.

The second leg assembly 106 has a given height "H2" (FIG. 13) taken perpendicular to the plane of the central portion 20 and from the top surface of the central portion 20 to the top edge (e.g., at fold line 44) of second leg assembly 106. The height H2 of the second leg assembly is greater than the length L2 of the second primary leg flap 24. The ratio of H2 to L2 may be at least any of the following: 1.2, 1.4, 1.6, 1.8, 2.0, 2.5, 3.0, and 4.0. The ratio of H2 to L2 may be at most any of the following: 6.0, 5.0, 4.0, 3.5, 3.0, 2.5, 2.0, 1.8, and 1.6.

In the engaged position 104 of the second auxiliary leg flap 34 of, for example, the embodiment of FIG. 13, the plane of the second proximal portion 46 may be non-perpendicular to the plane of the central portion 20, for example, the plane of second proximal portion 46 may form an angle α144 with respect to the plane of the central portion 20 that is at least any of 95°, 100°, 110°, and 120°; and for example at most 135°.

The creation of first leg assembly 128 (FIG. 13) is much the same as its counterpart second leg assembly 106. The first primary leg flap 22 is placed in a folded position 102 extending from the plane of the central portion 20 by folding the first primary leg flap 22 along first fold line 16. First auxiliary leg flap 30 is placed in an engaged position 104 in which the first auxiliary leg flap 30 extends from the plane of the central portion 20 to engage the first primary leg flap 22 in the folded position 102 to create the first leg assembly 128. (FIG. 13.) In more detail for this embodiment, first proximal portion 40 extends from the plane of the central portion 20 and the first distal portion 42 engages the first primary leg flap 22. In the illustrated embodiments, the engagement is made by folding the first auxiliary leg flap 30 along third fold line 32 and fourth fold line 38, and inserting first locking tab 70 into first slot 74 of the first primary leg flap 22 so that the first slot receives the first locking tab 70 in interlocking engagement 108 to create the first leg assembly 128. (FIG. 13.) Details regarding the interlocking engagements for this embodiment are similar to that discussed above, and therefore is not repeated here.

The first leg assembly 128 has a given height "H1" (FIG. 13) taken perpendicular to the plane of the central portion 20 and from the top surface of the central portion 20 to the top edge (e.g., at fold line 38) of first leg assembly 128. The height H1 of the first leg assembly is greater than the length L1 of the first primary leg flap 22. The ratio of H1 to L1 may be at least any of the following: 1.2, 1.4, 1.6, 1.8, 2.0, 2.5, 3.0, and 4.0. The ratio of H1 to L1 may be at most any of the following: 6.0, 5.0, 4.0, 3.5, 3.0, 2.5, 2.0, 1.8, and 1.6.

In the engaged position 104 of the first auxiliary leg flap 30 of, for example, the embodiment of FIG. 13, the plane of the first proximal portion 40 may be non-perpendicular to the plane of the central portion 20, for example, the plane of first proximal portion 40 may form an angle α146 with respect to the plane of the central portion 20 that is at least any of 95°, 100°, 110°, and 120°; and for example at most 135°.

The features of the interlocking engagement illustrated in the drawings may be reversed or swapped for an alternative arrangement, as discussed above.

Various Embodiments

The following sentences set forth various embodiments of the disclosed subject matter.

A. A frame useful in a suspension package, the frame comprising:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line;

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line;

the first proximal portion has a given length L3 from the third fold line to the fourth fold line;

L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line;

the second proximal portion has a given length L4 from the fifth fold line to the sixth fold line;

L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening.

B. The frame of sentence A wherein:

the first distal portion comprises a seventh fold line generally parallel to the fourth fold line and delineating the first distal portion into a first intermediate portion and a first remainder portion, the first intermediate portion being between the first remainder portion and the first proximal portion;

in the engaged position of the first auxiliary leg flap the first intermediate portion is generally parallel to the central portion;

the second distal portion comprises an eighth fold line generally parallel to the fifth fold line and delineating the second distal portion into a second intermediate portion and a second remainder portion, the second intermediate portion being between the second remainder portion and the second proximal portion; and in the engaged position of the second auxiliary leg flap the second intermediate portion is generally parallel to the central portion.

C. The frame of any one of the previous sentences A to B wherein the height of the first leg assembly extending from the central portion is greater than L1.

D. The frame of any one of the previous sentences A to C wherein the first distal portion comprises a locking tab and the first primary leg flap defines a slot for receiving the locking tab in interlocking engagement when the first auxiliary leg flap is in the engaged position.

E. The frame of sentence D wherein:

the first primary leg flap comprises a slot flap adjacent the slot and a non-slot flap remainder portion outside of the slot flap;

the slot flap is foldable from a disengaged position in which the slot flap is generally coplanar with the non-slot flap remainder portion of the first primary leg flap to an engaged position in which the slot flap extends from the plane of the non-slot flap remainder portion; and a section of the first remainder portion of the first distal portion is between the slot flap and the non-slot flap remainder portion when the first auxiliary leg flap is in the engaged position.

F. The frame of sentence E wherein the slot is non-linear to define a backstop protuberance.

G. The frame of any one of sentences A to C wherein the first primary leg flap comprises a locking tab and the first distal portion defines a slot for receiving the locking tab in interlocking engagement when the first auxiliary leg flap is in the engaged position.

H. The frame of sentence G wherein:

the first distal portion comprises a slot flap adjacent the slot and a non-slot flap remainder portion outside of the slot flap;

the slot flap is foldable from a disengaged position in which the slot flap is generally coplanar with the non-slot flap remainder portion of the first distal portion to an engaged position in which the slot flap extends from the plane of the non-slot flap remainder portion; and a section of the first primary leg flap is between the slot flap and the non-slot flap remainder portion when the first auxiliary leg flap is in the engaged position.

I. The frame of sentence H wherein the slot is non-linear to define a backstop protuberance.

J. The frame of any one of the previous sentences A to I wherein the ratio of L3 to L1 is at least 1.2, for example, at least one of any of the following: 1.4, 1.6, 1.8, 2.0, 2.5, 3.0, and 4.0.

K. The frame of any one of the previous sentences A to J wherein the ratio of L3 to L1 is at most 6.0, for example, at most one of any of the following: 5.0, 4.0, 3.5, 3.0, 2.5, 2.0, 1.8, and 1.6.

L. The frame of any one of the previous sentences A to K wherein the ratio of L4 to L2 is at least 1.2, for example, at least one of any of the following: 1.4, 1.6, 1.8, 2.0, 2.5, 3.0, and 4.0.

M. The frame of any one of the previous sentences A to L wherein the ratio of L4 to L2 is at most 6.0, for example, at most one of any of the following: 5.0, 4.0, 3.5, 3.0, 2.5, 2.0, 1.8, and 1.6.

N. A packaging assembly for packaging a product, the packaging assembly comprising:

a first suspension frame comprising a frame according to of any one of sentences A to M, wherein the first suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly;

a second suspension frame opposing the first suspension frame to create a product suspension region for suspending the product between the first and second suspension frames; and a box having interior dimensions corresponding to the opposing first and second suspension frames to contain the opposing first and second suspension frames within the box.

O. The packaging assembly of sentence N wherein the second suspension frame comprises a frame of any one of sentences A to M, wherein the second suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A frame useful in a suspension package, the frame comprising:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line;

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line;

the first proximal portion has a given length L3 from the third fold line to the fourth fold line;

L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line;

the second proximal portion has a given length L4 from the fifth fold line to the sixth fold line;

L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening.

2. The frame of claim 1 wherein:

the first distal portion comprises a seventh fold line generally parallel to the fourth fold line and delineating the first distal portion into a first intermediate portion and a first remainder portion, the first intermediate portion being between the first remainder portion and the first proximal portion;

in the engaged position of the first auxiliary leg flap the first intermediate portion is generally parallel to the central portion;

the second distal portion comprises an eighth fold line generally parallel to the fifth fold line and delineating the second distal portion into a second intermediate portion and a second remainder portion, the second intermediate portion being between the second remainder portion and the second proximal portion; and in the engaged position of the second auxiliary leg flap the second intermediate portion is generally parallel to the central portion.

3. The frame of claim 1 wherein the height of the first leg assembly extending from the central portion is greater than L1.

4. The frame of claim 1 wherein the first distal portion comprises a locking tab and the first primary leg flap defines a slot for receiving the locking tab in interlocking engagement when the first auxiliary leg flap is in the engaged position.

5. The frame of claim 4 wherein:

the first primary leg flap comprises a slot flap adjacent the slot and a non-slot flap remainder portion outside of the slot flap;

the slot flap is foldable from a disengaged position in which the slot flap is generally coplanar with the non-slot flap remainder portion of the first primary leg flap to an engaged position in which the slot flap extends from the plane of the non-slot flap remainder portion; and a section of the first remainder portion of the first distal portion is between the slot flap and the non-slot flap remainder portion when the first auxiliary leg flap is in the engaged position.

6. The frame of claim 5 wherein the slot is non-linear to define a backstop protuberance.

7. The frame of claim 1 wherein the first primary leg flap comprises a locking tab and the first distal portion defines a slot for receiving the locking tab in interlocking engagement when the first auxiliary leg flap is in the engaged position.

8. The frame of claim 7 wherein:

the first distal portion comprises a slot flap adjacent the slot and a non-slot flap remainder portion outside of the slot flap;

the slot flap is foldable from a disengaged position in which the slot flap is generally coplanar with the non-slot flap remainder portion of the first distal portion to an engaged position in which the slot flap extends from the plane of the non-slot flap remainder portion; and a section of the first primary leg flap is between the slot flap and the non-slot flap remainder portion when the first auxiliary leg flap is in the engaged position.

9. The frame of claim 8 wherein the slot is non-linear to define a backstop protuberance.

10. The frame of claim 1 wherein the ratio of L3 to L1 is at least 1.2.

11. The frame of claim 1 wherein the ratio of L3 to L1 is at most 6.0.

12. The frame of claim 1 wherein the ratio of L4 to L2 is at least 1.2.

13. The frame of claim 1 wherein the ratio of L4 to L2 is at most 6.0.

14. A packaging assembly for packaging a product, the packaging assembly comprising:

a first suspension frame comprising a frame, wherein:

the frame comprises:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line:

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line;

the first proximal portion has a given length L3 from the third fold line to the fourth fold line; L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line;

the second proximal portion has a given length L4 from the fifth fold line to the sixth fold line; L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening; and the first suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly;

a second suspension frame opposing the first suspension frame to create a product suspension region for suspending the product between the first and second suspension frames; and a box having interior dimensions corresponding to the opposing first and second suspension frames to contain the opposing first and second suspension frames within the box.

15. The packaging assembly of claim 14 wherein the second suspension frame comprises a second frame, wherein:

the second frame comprises:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line;

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line;

the first proximal portion has a given length L3 from the third fold line to the fourth fold line;

L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line:

the second proximal portion has a given length L4 from the fifth fold line to the sixth fold line;

L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening; and the second suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly.

16. The frame of claim 2 wherein the height of the first leg assembly extending from the central portion is greater than L1.

17. The frame of claim 2 wherein the first distal portion comprises a locking tab and the first primary leg flap defines a slot for receiving the locking tab in interlocking engagement when the first auxiliary leg flap is in the engaged position.

18. The frame of claim 2 wherein the ratio of L3 to L1 is at least 1.2.

19. A packaging assembly for packaging a product, the packaging assembly comprising:

a first suspension frame comprising a frame, wherein:

the frame comprises:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line;

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line:

the first proximal portion has a given length L3 from the third fold line to the fourth fold line;

L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line;

the second proximal portion has a given length L4 from the fifth fold line to the sixth fold line;

L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening;

wherein the first distal portion comprises a seventh fold line generally parallel to the fourth fold line and delineating the first distal portion into a first intermediate portion and a first remainder portion, the first intermediate portion being between the first remainder portion and the first proximal portion;

wherein, in the engaged position of the first auxiliary leg flap, the first intermediate portion is generally parallel to the central portion;

wherein the second distal portion comprises an eighth fold line generally parallel to the fifth fold line and delineating the second distal portion into a second intermediate portion and a second remainder portion, the second intermediate portion being between the second remainder portion and the second proximal portion; and wherein, in the engaged position of the second auxiliary leg flap, the second intermediate portion is generally parallel to the central portion; and the first suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly;

a second suspension frame opposing the first suspension frame to create a product suspension region for suspending the product between the first and second suspension frames; and a box having interior dimensions corresponding to the opposing first and second suspension frames to contain the opposing first and second suspension frames within the box.

20. The packaging assembly of claim 19 wherein the second suspension frame comprises a second frame, wherein the second frame comprises:

(1) a panel comprising:

(a) first and second opposing fold lines delineating:

a central portion between the first and second fold lines, wherein the central portion defines a panel opening;

a first primary leg flap extending from the first fold line, wherein:

the first primary leg flap is foldable along the first fold line from an unfolded position generally coplanar with the central portion to a folded position extending from the plane of the central portion; and the first primary leg flap has a given length L1 from the first fold line to the outer edge of the first primary leg flap opposite the first fold line;

a second primary leg flap extending from the second fold line, wherein:

the second primary leg flap is foldable along the second fold line from an unfolded position generally coplanar with the central portion to a folded position extending from the plane of the central portion; and the second primary leg flap has a given length L2 from the second fold line to the outer edge of the second primary leg flap opposite the second fold line;

(b) a first auxiliary leg flap foldably connected to the central portion along a third fold line generally parallel to the first fold line, wherein:

the first auxiliary leg flap has a fourth fold line generally parallel to the third fold line and delineating the first auxiliary leg flap into a first proximal portion between the third and fourth fold lines and a first distal portion extending from the fourth fold line;

the first proximal portion has a given length L3 from the third fold line to the fourth fold line;

L3 is greater than L1; and the first auxiliary leg flap is foldable from a disengaged position extending into the panel opening to an engaged position in which the first proximal portion extends from the plane of the central portion and the first distal portion engages the first primary leg flap in the folded position to create a first leg assembly;

(c) a second auxiliary leg flap foldably connected to the central portion by a fifth fold line generally parallel to the second fold line, wherein:

the second auxiliary leg flap has a sixth fold line generally parallel to the fifth fold line and delineating the second auxiliary leg flap into a second proximal portion between the fifth and sixth fold lines and a second distal portion extending from the sixth fold line:

the second proximal portion has a given length L4 from the fifth fold line to the sixth fold line;

L4 is greater than L2; and the second auxiliary leg flap is foldable from a disengaged position extending into the panel opening to an engaged position in which the second proximal portion extends from the plane of the central portion and the second distal portion engages the second primary leg flap in the folded position to create a second leg assembly; and (2) a sheet attached to the panel and extending over the panel opening;

wherein the first distal portion comprises a seventh fold line generally parallel to the fourth fold line and delineating the first distal portion into a first intermediate portion and a first remainder portion, the first intermediate portion being between the first remainder portion and the first proximal portion;

wherein, in the engaged position of the first auxiliary leg flap, the first intermediate portion is generally parallel to the central portion;

wherein the second distal portion comprises an eighth fold line generally parallel to the fifth fold line and delineating the second distal portion into a second intermediate portion and a second remainder portion, the second intermediate portion being between the second remainder portion and the second proximal portion; and wherein, in the engaged position of the second auxiliary leg flap, the second intermediate portion is generally parallel to the central portion; and the second suspension frame has:

(i) the first primary leg flap in the folded position and the first auxiliary leg flap in the engaged position to create the first leg assembly; and (ii) the second primary leg flap in the folded position and the second auxiliary leg flap in the engaged position to create the second leg assembly.

* * * * *